United States Patent [19]

Betts et al.

[11] Patent Number: 4,680,229

[45] Date of Patent: Jul. 14, 1987

[54] FLAME-RESISTANT HYDROCARBON POLYMER COMPOUNDS, AND INSULATED ELECTRICAL PRODUCTS THEREOF

[75] Inventors: Joseph E. Betts, Westport, Conn.; Fred F. Holub, Schenectady, N.Y.

[73] Assignee: General Electric Company, Bridgeport, Conn.

[21] Appl. No.: 737,357

[22] Filed: Jul. 22, 1985

Related U.S. Application Data

[63] Continuation of Ser. No. 516,609, Jul. 25, 1983, abandoned, which is a continuation of Ser. No. 285,655, Jul. 21, 1981, abandoned, which is a continuation-in-part of Ser. No. 816,854, Jul. 18, 1977, abandoned.

[51] Int. Cl.[4] ..... B32B 15/00; B32B 25/20

[52] U.S. Cl. ..... 428/389; 174/110 PM; 174/110 S; 428/372; 428/391; 428/921

[58] Field of Search ..... 428/372, 375, 379, 389, 428/447, 391, 383; 174/110 PM, 110 S; 252/8.1

[56] References Cited

U.S. PATENT DOCUMENTS

| | | | |
|---|---|---|---|
| 2,888,419 | 5/1959 | Safford . | |
| 2,888,424 | 5/1959 | Precopio et al. | 524/430 |
| 2,928,801 | 3/1960 | Safford et al. . | |
| 3,148,169 | 9/1964 | Martens et al. . | |
| 3,326,828 | 6/1967 | DeMelio | 524/399 |
| 3,900,681 | 8/1975 | Walters | 428/447 X |
| 3,960,739 | 6/1976 | MacKenzie | 174/110 PM |
| 4,123,586 | 10/1978 | Betts et al. | 428/391 |

*Primary Examiner*—Lorraine T. Kendell

*Attorney, Agent, or Firm*—Hedman, Gibson, Costigan & Hoare

[57] ABSTRACT

Halogen-free, flame-resistant hydrocarbon polymer compounds comprising an organopolysiloxane gum, and a lead compound, and electrical conductors insulated therewith.

17 Claims, 1 Drawing Figure

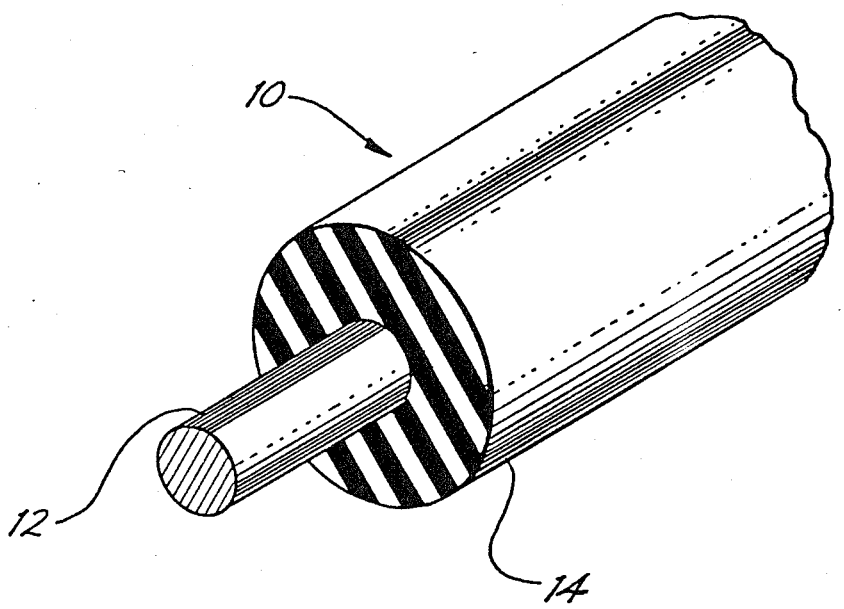
10
12
14

FLAME-RESISTANT HYDROCARBON POLYMER COMPOUNDS, AND INSULATED ELECTRICAL PRODUCTS THEREOF

This is a continuation of Ser. No. 516,609, filed July 25, 1983, now abandoned, which is a continuation of Ser. No. 285,655, filed July 21, 1981, now abandoned, which is a continuation-in-part of copending application of Joseph E. Betts and Fred F. Holub, Ser. No. 816,854, filed 7-18-77, now abandoned. Reference is also made to Ser. No. 816,855, filed July 18, 1977, now abandoned, for Flame Resistant Compositions and Electrical Products Thereof, to Ser. No. 006,713, filed Jan. 26, 1979, now U.S. Pat. No. 4,209,566 to U.S. Pat. No. 4,123,586, to U.S. Pat. No. 4,273,691, and to Ser. No. 196,989, filed Oct. 14, 1980, now abandoned, all assigned to the same assignee as the present invention.

BACKGROUND OF THE INVENTION

The significantly increased use of organic hydrocarbon based polymeric compositions, such as polyolefins, in many and diverse applications or products, and the relatively high combustibility of such hydrocarbon based polymeric materials, and their propensity to spread or propagate burning due to flow and dripping at high temperatures, has greatly stimulated the investigation of flame-proofing measures for such organic polymeric compositions. Moreover, the high costs of fire damage in lives and property, and the current trend of the imposition of increasingly stringent safety requirements, have substantially intensified the pursuit of more effective and practical means of controlling or inhibiting combustion and its spread or propagation in many products and materials comprising organic polymers.

Notwithstanding prior developments of a great number of flame-proofing measures or additives resulting from this expanding effort, there remains a continuing need for improvements to meet current or new requirements in this area. The magnitude and urgency of this need for even greater improvements in this area and the proliferation of efforts and developments in this field are best evidenced by the ever increasing number of publications produced dealing with this subject.

Among the numerous developments which have concerned themselves with additives to polyolefin base compositions used and useful in wire coating are developments reported in the patents of Safford Pat. No. 2,888,419 and Safford et al Pat. No. 2,928,801. The Safford '419 patent is directed to an improvement in the extrudability of a filled polyethylene composition. The filler referred to in Safford '419 is a particulate filler and, particularly, "finely divided silicas, calcium silicates, aluminas, and carbon blacks", as pointed out in Safford '419 at the bottom of column 3.

The importance of the addition of silicone compound to the filled polyethylene is pointed out in Safford '419, column 1, where Safford states:

> "However, in order to be extruded at high speeds the polymer should flow easily, form a smooth surface, and have a minimum of toughness or nerve. These properties are particularly difficult to obtain with filled polyethylene since filled polyethylene extrudes comparatively slowly and the extuded product has a rough surface."

Safford goes on to point out that a more extrudable composition is obtained by incorporating a minor amount of organopolysiloxane in the filled polyethylene.

Nowhere in the Safford '419 patent is there any mention of the prospect of obtaining benefit of addition of polysiloxane to unfilled polyolefin compositions nor is there any hint or suggestion of obtaining flame-retardant benefits from addition of organopolysiloxane additive or ingredient to either filled or unfilled polyolefin.

The Safford et al '801 patent concerns the addition of certain basic materials to a silica-filled polyethylene composition. The basic materials are recited at the top of column 2 of the patent and guanidine is identified as a preferred basic material. Also, other organic bases, basic organic salts and inorganic bases can be employed including lead oxide, magnesium oxide, zinc oxide, and a variety of other lead compounds. The basic materials are stated to have a "stabilizing effect" on uncured peroxide-containing filled polyethylene to permit their transportation in commerce without deleterious effects. Accordingly, the magnesium and zinc oxides are given as the equivalents of lead oxide and other lead compounds and guanidine is given as a preferred basic material.

As in the Safford '419 patent, there is no hint or suggestion in the Safford et al '810 patent of any benefit to be derived from use of the basic materials, including guanidine, lead oxide, magnesium oxide, zinc oxide or other lead compounds in relation to flame-retardance.

SUMMARY OF THE INVENTION

This invention comprises the discovery that effective resistance to flame or combustion, its spread or propagation due to loss of physical integrity and extensive volatilization, and other advantages, in hydrocarbon based polymers, such as polyolefins, can be attained by the incorporation therein of the combination of a polysiloxane gum and lead compound, without the presence of a halogen. The invention thus relates to flame-resistant hydrocarbon based polymer compounds, such as polyolefin polymers, and it has particular application or utility in flame-proofing electrical insulations such as for wire and cable comprising dielectric ethylene-containing polymer compounds, such as polyethylene, which have been crosslink cured to a substantially thermoset condition.

OBJECTS OF THE INVENTION

It is a primary obJect of this invention to provide hydrocarbon based polymer compounds having effective resistance to flame and combustion which do not require a halogen, and thereby avoid the disadvantages and problems attributable to halogens.

It is also an object of this invention to provide hydrocarbon based polymer compounds, such as polyolefins, having effective electrical and physical properties, and chemical properties such as resistance to heat aging as well as a high degree of resistance to flame and combustion and the spread or propagation of fire due to loss of physical integrity and extensive volatilization.

It is a further object of this invention to provide flame resistant hydrocarbon based polymer compounds such as polyolefins which are very flexible, and which effectively and extensively char at flame or combustion conditions and thereby resist loss of physical integrity and excessive volatilization.

It is a still further object of this invention to provide a new and improved electrical conductor comprising a metallic conductive element having a dielectric insulation thereabout of a crosslink cured polyolefin polymer compound which is resistant to flame and combustion, chars and minimizes volatilization and loss of physical integrity at flame temperatures, and has superior electrical and physical properties.

BRIEF DESCRIPTION OF THE DRAWING

The drawing comprises a perspective view of an insulated conductor comprising a metallic element having a crosslink cured polyolefin insulating compound of this invention thereabout.

DESCRIPTION OF A PREFERRED EMBODIMENT

In accordance with this invention, hydrocarbon based polymer compounds having an effective level of resistance to flame and combustion, a high level of physical integrity at high temperatures, among other advantages and improved attributes, are provided by a combination of such a hydrocarbon based polymer composition with effective amounts of an organopolysiloxane gum or elastomer and a lead compound, without the presence of a halogen.

The hydrocarbon based polymeric materials of this invention comprise polyolefins such as ethylene-containing polymers, for example polyethylene, both high and low density, copolymers of ethylene and other polymerizable materials, and blends of such polymers including copolymers. Typical copolymers of ethylene include, for example, ethylene-propylene copolymers and ethylenepropylene-diene terpolymers, ethylene-vinyl acetate, ethylene-ethyl acrylate and ethylene-methyl acrylate. Other hydrocarbon based polymers within the scope of this invention include polypropylene, ethylene butene copolymer, polybutylene, polypentene, polystyrene, styrene maleic anhydride copolymer, styrene acrylonitrile copolymer, acrylonitrile butadiene styrene copolymer, methacrylate butadiene styrene copolymer, polycarbonates, polyesters, and the like.

The flame-resistant, hydrocarbon based polymers, or compounds thereof, of this invention can additionally comprise fillers, for example extending or reinforcing components such as silica, clay or fibers, pigments, curing coagents, and other conventional additives including preservatives, such as antioxidants, modifying agents such as plasticizers, processing aids mold release ingredients or lubricants, and the like which are commonly compounded with molding or insulating polymers, or typical products formed therefrom such as, for example, electrical insulations. Moreover, the polymer compounds of this invention can also include auxillary flame retarding ingredients such as conventional flame retarding agents, for example, phosphates, halogens, borates, antimony oxides, and the like common flame retardants.

This invention also specifically applies to and includes any of the above-referenced hydrocarbon polymers which can be crosslink cured and thermoset, when effected by means of high energy irradiation such as by electrons or chemical means such as a heat-activatable organic peroxide crosslinking agent such as disclosed in U.S. Pat. Nos. 2,888,424; 3,079,370; 3,086,966; and 3,214,422. Suitable peroxide crosslinking curing agents comprise organic peroxides characterized by the structure:

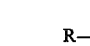

R—O—O—R wbich decompose at a temperature above about 146° C. (295° F.) and thereby provides free radicals. Preferred peroxides for curing polyolefins are a di-α-cumyl peroxide, and other apt peroxides comprising the tertiary diperoxides such as 2,5-dimethyl-2,4-di(t-butyl peroxy) hexane, and 2,5-dimethyl-2,4-di-t-butyl peroxy) hexyne-3, and the like diperoxy and polyperoxide compounds.

The organopolysiloxane gum or elastomer of this invention, for use in combination with a lead compound, among other preferred or optional ingredients, and the hydrocarbon polymer, comprises gums or organopolysiloxanes which have been condensed to a high molecular weight polymer of a gummy elastic, substantially semisolid state. For example, a typical silicone elastomer for use in the composition of this invention is a class of dimethylpolysiloxanes having the chemical structure:

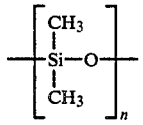

Other classes of silicone elastomers for use in this invention are the methyl-phenyl polysiloxanes, dimethyldiphenyl copolymers, and all such silicones containing minor amounts of vinyl groups. Further examples of the type of silicone elastomer gums usable in obtaining the compositions of this invention comprise the organopolysiloxanes referred to in U.S. Pat. Nos. 2,888,424 and 2,888,419, and identified in detail in U.S. Pat. Nos. 2,448,556; 2,448,756; 2,457,688; 2,484,595; 2,490,357; 2,521,.528; 2,541,137; 3,098,836; and 3,341,489. Such high molecular weight silicone polymers normally have Brookfield viscosities of in excess of about 100,000 centipoise at 25° C.

The lead compound comprises dibasic lead phthalate, lead stearate, lead sebacate, tribasic lead maleate, basic lead silicate sulfate, and comparable lead compounds.

It is highly preferred that the compositions of this invention also include effective amounts of conventional antioxidants, such as polymerized 1,2-dihydro-2,2,4 trimethylquinoline, which in combination with the other essential ingredients, provides a high degree of resistance in the compound to flow or dripping when exposed to flame or combustion temperatures.

Fumed silica fillers also comprise a preferred ingredient which enhances the overall resistance to flame and other desired attributes in some embodiments of the hydrocarbon polymer compounds of this invention. Also fumed silica can be employed as an aid to improve dispersion of the silicone gum with the other ingredients. Fumed silica comprises a form of silica described in U.S. Pat. No. 2,888,424, and a type which is sold under the trade designation of Cabosil MS7 of Godfrey L. Cabot, Inc., of Boston, Mass.

The essential combination of organopolysiloxane gum, with the lead compound, and preferred ingredients such as an antioxidant and fumed silica, can be mixed and combined with a hydrocarbon based polymer material or compound thereof, by means of any conventional compounding method or apparatus, such as working in a Banbury mixer or on a two roll rubber mill.

If the polymer compound is to be cured with a heat activatable curing agent such as an organic peroxide, it is preferred that all ingredients of the compound formulation, except the heat decomposable organic peroxide curing agent or any other ingredients which are sensitive to the relatively moderate mixing temperatures of about 150° C. (300° F.) to about 205° C. (400° F.), are combined and initially admixed together at a temperature sufficient to soften and plasticize the particular polyolefin polymer ingredients. Following the attainment of substantial uniformity of the initially admixed ingredients, the temperature of the admixed batch is reduced below the decomposition level of the particular peroxide curing agent used, or other heat sensitive ingredients to be added, and the curing agent or other heat sensitive ingredients are then introduced and dispersed preferably uniformly throughout the mix.

The proportions of the essential ingredients of the combination of this invention, as well as the optional ingredients and/or conventional additives or compounding agents can be varied and depend primarily upon the level or degree of resistance to flame and combustion, or charring, of the polymer, or compound thereof, and the relative flammability or combustibility of the polymer or compound ingredients and their ratios. However, effective resistance to flame or combustion, and effective charring, in many typical polymer compounds can be achieved with ratios of the respective ingredients in the following approximate relative parts by weight of:

| | |
|---|---|
| Hydrocarbon based polymer | 100 |
| Organopolysiloxane gum | 2–20 |
| Lead compound | 2–15 |
| Fumed silica | 0–10 |
| Antioxidant | 0–10 |
| Filler | 0–50 |
| Organic peroxide curing agent | 0–10 |

In a preferred embodiment of this invention for a highly effective electrical insulation having a high degree of resistance to flame and combustion, and substantial charring at flame temperature, the ingredients and their proportions comprise the following in the approximate relative parts by weight of:

| | |
|---|---|
| Polyolefin | 100 |
| Organopolysiloxane | 3–10 |
| Dibasic lead phthalate | 1–5 |
| Fumed silica | 2–6 |

-continued

| | |
|---|---|
| Antioxidant | 1–6 |
| Antimony oxide | 0–15 |
| Filler | 0–30 |
| Curing coagent | 0.5–2 |
| Organic tertiary peroxide curing agent | 1–5 |

The following examples of the compositions of this invention and data derived therefrom demonstrate the resistance to flame or combustion, and charring, as well as other beneficial and improved attributes, of the halogen-free, novel compositions of the invention, with respect to similar compositions for standards of comparison. The polymer composition formulations of the examples of this invention and also of the standards are all given in parts by weight, and the compositions of the examples of this invention and of their respective standards were each prepared, crosslink cured where indicated, and tested or evaluated under identical conditions.

The relative degrees of resistance to flame and combustion of the various compositions of the examples of this invention and of the standards were all determined in accordance with the Oxygen Index Test procedure prescribed in ASTM Test Method D-2863-70, and as described in U.S. Pat. Nos. 3,755,214 and 2,787,356. As is known, this test designates the fraction of oxygen by volume in nitrogen required to just maintain flaming of the material of the test sample. Thus, the higher the oxygen index for a composition, the better its resistance to flame and combustion.

TABLE I

| INGREDIENTS | EXAMPLE I COMPONENTS IN PARTS BY WEIGHT | | | | | | | | | | |
|---|---|---|---|---|---|---|---|---|---|---|---|
| Polyethylene | 100 | 100 | 100 | 100 | 100 | 100 | 100 | 100 | 100 | 100 | 100 |
| Organopolysiloxane gum | — | 4 | — | — | 4 | — | 4 | 4 | 4 | 4 | 4 |
| Dibasic lead phthalate | — | — | 3 | — | — | 3 | 3 | 3 | 3 | 3 | 3 |
| Antioxidant | | | | | | | | | | | |
| Agerite MA* | | | | 1.5 | 1.5 | 1.5 | — | 1.5 | 1.5 | 1.5 | 1.5 |
| Santowhite Crystals** | | | | 0.25 | 0.25 | 0.25 | — | 0.25 | 0.25 | 0.25 | 0.25 |
| Silicone fluid | | | | | | | — | — | 3 | — | 3 |
| Fumed silica | | | | | | | — | — | — | 1 | 1 |
| PROPERTIES | | | | | | | | | | | |
| Molded 3 min. at 182° C. | | | | | | | | | | | |
| Oxygen Index, percent | 16.8 | 18.2 | 18.0 | 16.8 | 19.4 | 18.4 | 22.0 | 25.0 | 25.0 | 30.5 | 28.3 |
| Char Formation (UL-94-HB) | No | No | No | No | No | No | Yes | Yes | Yes | Yes | Yes |

*Polymerized trimethyl dihydroquinoline
**4,4'-thiobis-(6 tert-butyl-m-cresol

Referring now to Table I - Example I, the first three tests listed in the example show that in the absence of either organopolysiloxane or dibasic lead phthalate, an oxygen index of 16.8 is observed. With the addition of 4 parts of organopolysiloxane gum, the oxygen index increases by 1.4 units to 18.2. With the addition of 3 parts of dibasic lead phthalate alone, there is an increase of the oxygen index to 18.0, or an increase of 1.2 over the polyethylene composition free of any additive.

From these three results, one might conclude that if 4 parts of organopolysiloxane gum and 3 parts of dibasic lead phthalate were added at the same time, that the total increase would be the 1.4 unit increase observed with the addition of the organopolysiloxane gum plus the 1.2 unit increase observed with the addition of the dibasic lead phthalate. In other words, a total increase of 2.6 units of the oxygen index would be expected. However, from the 7th example of the series listed in Table I - Example I, it is observed that when both organopolysiloxane gum and dibasic lead phthalate are added, that the actual increases to an oxygen index of 22. Accordingly, the increase from the addition of both the organopolysiloxane gum and dibasic lead phthalate is 5.2 units of the oxygen index as contrasted with the 2.6 units which might be expected from the results given for the first three tests as discussed above. A singularly unique and unexpectedly increased beneficial result is thus obtained from the combined addition as contrasted with the results obtained from the separate additions of the same ingredients in the same amounts.

Similarly, for the 4th, 5th and 6th tests of Table I - Example I, it is observed that a base oxygen index of test 4 is 16.8 and an oxygen index increase of 2.6 units is found when the 4 parts of organopolysiloxane gum are added and an increase of 1.6 units of the oxygen index is found when the 3 parts of dibasic lead phthalate are added. In the tests 4, 5 and 6, there is a co-presence of the antioxidants Agerite MA and Santowhite Crystals which are the same for all the three tests 4, 5 and 6. From these results, an overall increase of 4.2 units of oxygen index might be expected based on the 2.6 unit increase with the addition of 4 parts or organopolysiloxane gum and the 1.6 unit increase with the addition of 3 parts of dibasic lead phthalate. However, by observing the 8th test of the series, it is evident that the actual increase in oxygen index was to 25.0 and, accordingly, the increase from the addition of both the organopolysiloxane gum and the dibasic lead phthalate in the co-presence of the Agerite MA and Santowhite Crystals was 8.2 units of oxygen index rather than 4.2 units which might be expected from the results given in tests 4, 5 and 6.

Accordingly, there is observed what might be referred to as a synergistic increase in the oxygen index where the two additives, organopolysiloxane gum and dibasic lead phthalate, are added together into a composition as contrasted with the individual addition of each of these ingredients into a base polymer composition.

ment in oxygen index may be observed. For example, considering first the first three tests of Table II, it is observed that the oxygen index of the polyethylene containing the peroxide curing agent and the triallyl cyanurate curing coagent alone has the oxygen index of 16.8. This index is increased by 2.4 units to 19.2 with the addition of organopolysiloxane gum alone. The base index of 16.8 is increased by 0.6 units to 17.4 with the addition of dibasic lead phthalate alone.

However, in test 7 where both the organopolysiloxane gum and dibasic lead phthalate are added simultaneously in addition to the other ingredients listed, the oxygen index increases to 23.6 or, in other words, there is an increase of 6.8 units over the base index of 16.8 when both the organopolysiloxane gum and the dibasic lead phthalate are absent. From the tests 2 and 3, where the organopolysiloxane gum alone accounts for an increase in the oxygen index of 2.4 and where the addition of dibasic lead phthalate alone accounts for an increase of 0.6, one might expect an overall increase of 3.0 (as the sum of 2.4 and 0.6) to be observed when both the organopolysiloxane gum and dibasic lead phthalate are added simultaneously as they are in test 7. However, rather than the expected oxygen index increase of 3.0, there is actually observed an oxygen index increase of 6.8. Accordingly, there occurs what might be referred to as a synergistic increase in the oxygen index.

Considering next the tests 4, 5 and 6 of Table II, here again there is a relatively modest increase in the oxygen index where the organopolysiloxane gum is added alone and where the dibasic lead phthalate is added alone. The actual increases are 1.0 for the addition of the organopolysiloxane gum and 0.2 for the addition of dibasic lead phthalate where 17.2 is used as the base oxygen index for a composition of test 4 in which neither of the additives is present. Accordingly, the expected increase in the sum of the two individual increases is 1.2. However, from test 8, it is observed that the actual increase is to 25.7 and from a base oxygen index of 17.2, this represents an actual increase of 8.5 rather than the 1.2

TABLE II

| INGREDIENTS | EXAMPLE II COMPONENTS IN PARTS BY WEIGHT | | | | | | | | | | | |
|---|---|---|---|---|---|---|---|---|---|---|---|---|
| Polyethylene | 100 | 100 | 100 | 100 | 100 | 100 | 100 | 100 | 100 | 100 | 100 | 100 |
| Dicumylperoxide, curing agent | 3.5 | 3.5 | 3.5 | 3.5 | 3.5 | 3.5 | 3.5 | 3.5 | 3.5 | 3.5 | 3.5 | 3.5 |
| Triallyl cyanurate, curing coagent | 1.5 | 1.5 | 1.5 | 1.5 | 1.5 | 1.5 | 1.5 | 1.5 | 1.5 | 1.5 | 1.5 | 1.5 |
| Organopolysiloxane gum | — | 4 | — | — | 4 | — | 4 | 4 | 4 | 4 | 4 | 5 |
| Dibasic lead phthalate | — | — | 3 | — | — | 3 | 3 | 3 | 3 | 3 | 3 | 3 |
| Antioxidants | | | | | | | | | | | | |
| Agerite MA* | | | | 1.5 | 1.5 | 1.5 | — | 1.5 | 1.5 | 1.5 | 1.5 | 1.5 |
| Santowhite Crystals** | | | | 0.25 | 0.25 | 0.25 | — | 0.25 | 0.25 | 0.25 | 0.25 | 0.25 |
| Silicone liquid | | | | | | | — | — | 3 | — | 3 | 3 |
| Fumed silica | | | | | | | — | — | — | 1 | 1 | — |
| PROPERTIES | | | | | | | | | | | | |
| Crosslink cured 45 min. at 182° C. | | | | | | | | | | | | |
| Oxygen Index, percent | 16.8 | 19.2 | 17.4 | 17.2 | 18.2 | 17.4 | 23.6 | 25.7 | 25.0 | 29.7 | 29.9 | 30.9 |
| Char Formation (UL-94-HB) | NO | NO | NO | NO | NO | NO | YES | YES | YES | YES | YES | YES |

*Polymerized trimethyl dihydroquinoline
**4,4'-thiobis-(6 tert-butyl-m-cresol)

Referring next to Table II - Example II, a similar pattern of what may be termed a synergistic improve-which might be expected from the results given in tests 4, 5 and 6.

TABLE III

| INGREDIENTS | EXAMPLE III COMPONENTS IN PARTS BY WEIGHT | |
|---|---|---|
| Polyethylene | 100 | 100 |

TABLE III-continued

| INGREDIENTS | EXAMPLE III COMPONENTS IN PARTS BY WEIGHT | | | | | | | | | |
|---|---|---|---|---|---|---|---|---|---|---|
| Polyethylene, High Density | | | 100 | 100 | | | | | | |
| Ethylene-propylene polyallomer | | | | | 100 | 100 | | | | |
| Polystyrene, High Impact | | | | | | | 100 | 100 | | |
| Styrene malic anhydride | | | | | | | | | 100 | 100 |
| Polysiloxane gum | — | 4 | — | 4 | — | 4 | — | 4 | — | 4 |
| Dibasic lead phthalate | — | 3 | — | 3 | — | 3 | — | 3 | — | 3 |
| PROPERTIES | | | | | | | | | | |
| Molded 3 mm. at 182° C. | | | | | | | | | | |
| Oxygen Index, percent | 16.8 | 22.0 | 15.0 | 27.0 | 17.6 | 21.0 | 18.2 | 27.2 | 18.0 | 21.0 |
| Char (UL-94-HB) | No | Yes | No | Yes | No | Yes | Little | Yes | Little | Yes |

TABLE IV

| INGREDIENTS | EXAMPLE IV COMPONENTS IN PARTS BY WEIGHT | | | | |
|---|---|---|---|---|---|
| Polyethylene | 100 | 100 | 100 | 100 | 100 |
| Polysiloxane gum | — | 4 | — | — | — |
| Dibasic lead phthalate | — | 3 | 3 | 3 | 3 |
| Fumed silica* | 3.5 | 3.5 | 4 | 8 | 16 |
| Triallyl cyanurate | 1.5 | 1.5 | 1.5 | 1.5 | 1.5 |
| Dicumyl peroxide | 3.5 | 3.5 | 3.5 | 3.5 | 3.5 |
| PROPERTIES | | | | | |
| Crosslink cured 45 min. at 182° C. | | | | | |
| Oxygen Index, percent | 16.8 | 23.6 | 20.0 | 20.3 | 21.9 |
| Char (UL-94-HB) | No | Yes | Yes | Yes | Yes |

*Treated with 5% wt. octamethyl tetrasiloxane

EXAMPLE V

| INGREDIENTS | PARTS | PERCENT |
|---|---|---|
| Polyethylene | 100 | 82.82 |
| Polysiloxane gum* | 5 | 4.14 |
| Dibasic lead phthalate (25% polybutene) | 4 | 3.31 |
| Octamethylcyclotetra siloxane | 3 | 2.48 |
| Antioxidants | | |
| Flectol-H | 1.5 | 1.24 |
| Santowhite Crystals | 0.25 | 0.21 |
| Pigment - titanium oxide | 2 | 1.66 |
| Triallyl cyanurate | 1.5 | 1.24 |
| Dicumyl peroxide | 3.5 | 2.90 |

*Vinyl containing polysiloxane, containing minor amounts of siloxane treated fumed silica and diatomaceous earth.

When crosslink cured at 182° C. (360° F.) for 45 minutes, the polymer compound of Example III exhibited the following properties:

Toluene extraction: 10% based on polymer
Tensile strength: 2779 psi
Elongation: 318%
After heat aging 7 days at 121° C.
Tensile strength: 2832 psi (102% retention)
Elongation: 336 (106% retention)
Oxygen Index, percent: 30.2
Char (UL-94-HB): Yes
Drip: Slightly The composition of Example V extruded on #14 copper wire in a wall thickness of each 0.030 inch and 0.045 inch passed the UL-44-XHHW and RHH-RHW Horizontal Flame Test and did not drip, while comparable crosslink cured, unfilled polyethylene compositions without the flame retardant system of this invention both failed this test and dripped.

The flame resistant, charring hydrocarbon polymers, or compounds thereof, of this invention are particularly useful materials for dielectric insulations for electrical conductors such as wire and cable.

Referring to the drawing, there is shown a typical construction for an insulated electrical wire or cable product 10, comprising a metallic conductive element 12 and an overlying body of cured polymeric insulation 14 extending thereabout or covering the conductor. In the drawing, the product 10 is illustrated as a short section with the insulation 14 removed from the end portion of the conductor 12. According to one embodiment of this invention, the novel flame-resistant hydrocarbon polymer thereof can be used to provide or form the insulation 14 on conductive element 12 of wire or cable product 10. It is to be understood from the foregoing, however, that the insulation can comprise a coating on any portion of a conductive element and that the insulation need not completely enclose the element where such is not necessary for a desired insulative effect.

A series of tests were performed to determine the effect of magnesium oxide, zinc oxide and guanidine compositions recited in the U.S. Pat. No. 2,928,801 as being essentially equivalent with regard to serving equally well as "basic materials" of that patent, guanidine having been recited as a preferred basic material. The tests showed conclusively that the magnesium oxide, zinc oxide and guanidine are not equivalents of the lead compound in their functioning in the context of the combination of the subject invention. The tests performed demonstrated that the magnesium oxide, zinc oxide and guanidine are very significantly inferior in the combination with silicone gum to the combination of silicone gum with the lead compound used in these comparative tests. Accordingly, it was found that while these compounds may be equivalents in the context of U.S. Pat. No. 2,928,801, they simply are not equivalent or substantially equivalent in the context of the combinations of this invention.

In carrying out these tests, a first master batch composition was prepared containing the following ingredients:

| INGREDIENT | PARTS |
|---|---|
| Low Density Polyethylene | 100 |
| Agerite MA | 1.5 |
| Santowhite Crystals | 0.25 |
| Polysiloxane Gum | 5 |
| Triallyl Cyanurate | 1.5 |

The master batch composition prepared with the above ingredients had a total of 108.25 parts and is identified for purposes of reference as Master Batch ID-92-81. The preparation steps included the melting of polyethylene on a plastic mill at 240 to 250° F. and milling the plastic to a band. Next, the polysiloxane gum was added in a manner to give good dispersion. The Agerite MA powder and Santowhite Crystals were then added to the composition being milled. The triallyl cyanurate was then added.

The resultant master batch composition was then divided into batches of 542 parts for use in individual tests as described below.

EXAMPLE VI

Referring to Table VI, there is tabulated the ingredients of a series of compositions and test data obtained from tests of the compositions.

Starting with the first test 1 of Example VI, no master batch was used in this test. Some 600 parts of low density polyethylene were blended on a plastic mill at a temperature of 240°–250° F. with 9 parts of Agerite MA, 1.5 parts of a commercially available antioxidant sold under the designation Santowhite Crystals, and 9 parts of triallyl cyanurate.

The composition was divided in half and a sample of a first half was prepared for an oxygen index test. The preparation of the sample involved forming a slab of 0.125 inch thickness. The slab was prepared by introducing a portion of the composition into a mold held in a press and pre-heated to 250° F. The mold temperature was raised to 360° F. and the slab sample was pressed at 360° F. for 10 minutes. The slab was allowed to cool in the press to room temperature. The slab was subjected to an oxygen index test as described above and an oxygen index of 17.5 was observed for the composition. A sample was also subjected to a horizontal burn test and it was observed that the composition dripped. This is indicated in the Table VI by the letter "D". It was also observed that once the sample was ignited according to horizontal burn test UL-94-HB, that the flame propagated horizontally along the wire for a distance of about 1 inch in a period of 30 seconds.

press all the way and then raising the temperature to 360° F. (182° C.). The composition was heated in the press at this higher temperature for 45 minutes and the temperature of the composition was allowed to cool to room temperature before it was taken out of the press. The slab prepared in this manner had a thickness of 0.125 inches. A sample was prepared from the slab for oxygen index testing as well as for horizontal burn testing according to Underwriters Laboratory test procedure UL94. As part of the horizontal burn test procedure, an observation was made of the linear extent of propagation of any flaming of the test sample during a 30-second observation interval. The results of the horizontal propagation are given in inches in Table VI under 1A.

The procedures recited in reference to example VI-1 and VI-1A were repeated in VI-2 and VI-2A. The composition VI-2 is the master batch composition containing the ingredients recited above for the master batch in the proportions set forth. One such ingredient is the polysiloxane gum which is present in the ratio of 5 parts per hundred parts of polyethylene. Where the master batch is recited to be present to the extent of 542 parts, this represents 5 times the total of the ingredients as set forth above, but the parts of each ingredient per 100 parts of polyethylene remain the same as is recited above in describing the ingredient ratios of the master batch. In other words, in setting out the ingredient ratios above, the total of ingredients was listed as 108.25 parts. The 542 parts of master batch listed in Table VI represents 5 times the amount listed above, namely 108.25 parts, but includes the same ingredients in the same ratios as listed for the master batch. Accordingly, in the test sample VI-2, all of the ingredients are present in 5 times the amount indicated in the master batch composition listed above. Accordingly, the silicone

TABLE VI

ID-92-81 Master batch
Polyethylene = 100; Agerite MA = 1.5; Santowhite Crystals = 0.25; 903 Silicone Gum = 5; Triallyl Cyanurate = 1.5
Total = 108.25

| | 1 | 1A | 2 | 2A | 3 | 3A | 4 | 4A | 5 | 5A | 6 | 6A | 7A | 8A | 9A | 10A |
|---|---|---|---|---|---|---|---|---|---|---|---|---|---|---|---|---|
| Masterbatch | — | — | 542 | 542 | 542 | 542 | 542 | 542 | 542 | 542 | 542 | 542 | — | — | — | — |
| Polyethylene | 600 | 300 | — | — | — | — | — | — | — | — | — | — | 600 | 600 | 600 | 600 |
| Agerite MA* | 9 | 4.5 | — | — | — | — | — | — | — | — | — | — | 9 | 9 | 9 | 9 |
| Santowhite Crystals** | 1.5 | 0.75 | — | — | — | — | — | — | — | — | — | — | 1.5 | 1.5 | 1.5 | 1.5 |
| Triallyl Cyanurate | 9 | 4.5 | — | — | — | — | — | — | — | — | — | — | 9 | 9 | 9 | 9 |
| Dicumyl Peroxide | — | 10.5 | — | 17.5 | — | 17.5 | — | 17.5 | — | 17.5 | — | 17.5 | 21 | 21 | 21 | 21 |
| Dythal, dibasic lead phthalate | — | — | — | — | 15 | 15 | — | — | — | — | — | — | 18 | — | — | — |
| Magnesium Oxide | — | — | — | — | — | — | 15 | 15 | — | — | — | — | — | 18 | — | — |
| Zinc Oxide | — | — | — | — | — | — | — | — | 15 | 15 | — | — | — | — | 18 | — |
| DOTG, Di-ortho-tolyl guanidine | — | — | — | — | — | — | — | — | — | — | 15 | 15 | — | — | — | 18 |
| Oxygen Index | 17.5 | 17.5 | 16.5 | 17.3 | 21.5 | 28.5 | 17.2 | 17.5 | 17.3 | 17.7 | 17.5 | 18.0 | 16.6 | 16.6 | 16.6 | 16.4 |
| UL-94 H.B. | D | D | D | D | D | ND | D | D | D | D | D | D | D | D | D | D |
| Propagation | 1 | ¾ | 1 | ¾ | ¾ | NP | 1 | ¾ | 1 | ¾ | 1 | ¾ | 1 | 1 | 1 | 1 |

D = DRIP; ND = NO DRIP; NP = NO PROPAGATION
*1,2 dihydro-2,2,4-trimethyl quinoline
**4,4' thiobis-(6 tert-butyl-m-cresol)

Considering next the test 1A of Example VI, the second approximately one-half of the sample prepared according to test VI-1 above was processed on a plastic mill to form a band at 240 to 250° F. 10.5 grams of a peroxide crosslinking agent, specifically dicumyl peroxide, were added to the second half of the composition of test sample VI-1 and the peroxide was distributed uniformly in the composition by working on the plastic mill.

A portion of the test sample VI-1A was cured by placing it in a mold in a press at 250° F., closing the gum is present in approximately 5 times the value indicated in the listing of the composition of the master batch and, accordingly, it is present to the extent of 25 parts in the test samples VI-2 through VI-6 as well as in test samples VI-2A through VI-6A.

A slab was prepared from the composition prepared according to sample VI-2 and its oxygen index and horizontal burn behavior was tested as described above for sample VI-1. An oxygen index of 16.5 was observed and the horizontal burn test indicated that drips did occur and that the flame propagation in the 30-second test period was approximately 1 inch.

542 parts of master batch were placed on a plastic mill and banded in the manner described above with reference to test sample VI-1A, and 17.5 parts of peroxide were added to and blended into the master batch. The concentration of peroxide is approximately equivalent to the concentration of peroxide in test sample VI-1A above. The test sample VI-1A contained 10.5 parts of the peroxide and 300 parts of polyethylene and the test sample VI-2A contained 17.5 parts of peroxide in 500 parts of polyethylene. Accordingly, the peroxide concentration is 3.5 parts per hundred in both compositions.

A slab was prepared from the composition resulting from the preparation of test sample VI-2A in the manner described for test sample VI-1A above and the slab sample was tested. The test results are listed in the Table under test sample VI-2A.

Turning next to the test samples 3 and 3A, for the sample 3 without the peroxide, 542 parts of the master batch prepared as described above were blended on a plastic mill with 15 parts of dibasic lead phthalate followed by preparation of a test slab. Testing of the slab gave the results listed in the Table, specifically, an oxygen index of 21.5 and a UL horizontal burn which showed the formation of drops and flame propagation of ¾ of an inch.

A test sample VI-3A was prepared in the manner described above with reference to sample VI-2A and a slab of this material was tested. The results obtained are listed in Table VI and indicate that the results obtained were an oxygen index of 28.5. In addition, it was observed that no drips were formed as a result of the horizontal burn test UL-94 and, further, that there was no flame propagation as a result of this test.

The results obtained for the samples VI-3 and VI-3A above are very significant in that they establish that there is a very marked increase in the oxygen index of the samples as compared to samples VI-2 and VI-2A. For the noncrosslinked or thermoplastic samples 2 and 3, the oxygen index value changed from approximately 16.5 for sample VI-2 to 21.5 for sample VI-3. This is an increase of 5.0 units in the oxygen index.

Further, the oxygen index measured for the crosslinked master batch containing the dibasic lead phthalate is increased significantly over the crosslinked master batch which did not contain the lead. Thus, the oxygen index value for the lead-containing phthalate of sample 2A is shown to be 28.5 and the comparable oxygen index for sample VI-2A is 17.3. Accordingly, there is an increase of 11.2 units in the oxygen index measured for these respective compositions.

The procedures recited with reference to samples VI-3 and 3A were repeated for samples 4 and 4A, but in samples 4 and 4A, 15 parts of magnesium oxide were substituted for the 15 parts of dibasic lead phthalate of samples 3 and 3A. Tests were performed on samples VI-4 and VI-4A and the test results are listed in the Table VI. It is evident that the magnesium oxide does not affect the oxygen index. Rather, the oxygen index of sample VI-4 is increased over the test sample VI-2 by only 0.7 units as compared to 5.0 units for VI-3. Accordingly, the lead compound is approximately 7 times more effective in increasing the oxygen index than is the magnesium oxide. This result is obtained by comparing the 5.0 unit increase of test sample VI-3 with the 0.7 unit increase of test sample VI-4.

Similarly, the magnesium oxide fails to increase the oxygen index of the crosslinked sample VI-4A to anywhere near the degree which the lead increased the index for sample VI-3. This is observed by the fact that there is an 11.2 unit increase in the oxygen index from comparison of sample VI-2A with sample VI-3A whereas there is only a 0.2 unit increase between the sample VI-4A as compared with sample VI-2A. Moreover, the test sample VI-4A did drip and did permit the flame to propagate whereas sample VI-3A did not drip and no flame propagation took place.

Considering next test samples VI-5 and VI-5A, the procedures employed in preparing test samples VI-3 and VI-3A were repeated but, in this case, zinc oxide was substituted for the lead compound of the test samples VI-3 and VI-3A.

The test sample VI-5 was thermoplastic in that it did not contain any peroxide. Tests performed on the test sample VI-5, as described above with reference to test sample VI-2, gave the results indicated under the respective samples. Thus, the oxygen index of test sample VI-5 was 17.3 or 0.8 units higher than the oxygen index measured for test sample VI-2.

The crosslinked composition VI-'5A was prepared in the manner described above with reference to the test sample VI-3A. The test results obtained are listed under test sample VI-5A. As evident from the Table, the oxygen index measured was 17.7 units, or 0.4 units higher than the test sample VI-2A.

Further, both the samples dripped as indicated in the Table and did have propagation of flame in the 30-second test interval.

It is accordingly evident from the test results obtained from testing of the zinc oxide additive, that zinc oxide is not the equivalent of the lead compound employed in the examples VI-3 and VI-3A and that, in fact, the results obtained from the tests with the zinc oxide compound are far inferior to the tests obtained with the lead compound and are not, in fact, appreciably better than the poor results obtained with the magnesium oxide in test samples VI-4 and VI-4A.

Turning next to the samples VI-6 and VI-6A, the procedures described with reference to VI-3 and VI-3A were repeated but, in this case, a guanidine additive was substituted for a like amount of the lead compound additive. The compositions were prepared according to the stated procedure, using tests as set out in the description above and the results of these tests are listed in the Table VI under the heading "6" and "6A" respectively. As is evident from the listed results, the addition of guanidine in sample VI-6 resulted in an increase in the oxygen index by 1.0 units from the 16.5 value of sample VI-2 to the 17.5 units of VI-6. This 1.0 unit increase in oxygen index is 5 fold less than the increase observed when the lead compound was employed as is set forth in example VI-3 above.

Considering next the results obtained from the example VI-6A, the oxygen index was increased to a value of 18.0 from the 17.3 value set forth for example VI-2A, which was crosslinked but which did not contain any guanidine additive or any other additive. Accordingly, the increase in oxygen index was a value of 0.7 and this compares with the increase of 11.2 which was found where the lead additive was employed in the example VI-3A as stated above.

From these results, it is evident that the lead compound is some 16 fold better in its ability to increase the oxygen index in a crosslinked composition as compared to any of the other three additives which were employed in the tests reported in Table VI.

This demonstrates conclusively that the compounds, and specifically guanidine, magnesium oxide, zinc oxide and the lead compound dibasic lead phthalate, are not equivalents from the point of view of their ability to interact with a composition containing a silicone gum, as set forth in this application, to improve the flame retardance of a polymer composition in which they are distributed as additives.

Turning now to the remainder of the test samples which are reported in the Table VI, these test samples, specifically, 7A, 8A, 9A and 10A, are samples which are included to complete the basis for comparison of the results which are obtained. In the four test samples, the four compounds are namely dibasic lead phthalate, magnesium oxide, zinc oxide and guanidine and these compounds are added to a composition as defined in example VI-1A in the manner disclosed in examples VI-1A and VI-3A, and the tests performed as described in these earlier examples are repeated to determine the oxygen index and the horizontal burn test UL-94. As is evident from the listing of the oxygen index values under the respective examples, it is evident that there is essentially no improvement in the oxygen index from the addition of any of the four compounds to the base composition and that, in fact, the oxygen index of the polymer compositions with the four compounds added is below the values obtained for the essentially equivalent composition with the compounds omitted. Thus, the oxygen index for the sample VI-1A was 17.5, and the highest value of oxygen index found for any of the last four samples VI-7A, 8A, 9A and 10A is 16.6. Similarly, the oxygen index for the sample VI-2A is 17.3 and this is 0.7 units higher than the highest value found for any of the samples VI-7A through VI-10A. Accordingly, it is evident that the results as set forth here confirm that there is no increase in the ocygen index of the composition containing the additive compound in the absence of silicone gum. Accordingly, this is a further demonstration of the unique and novel results obtained by the combination of the lead compound and the silicone gum as set forth in this application as originally filed.

Although the invention has been described with reference to certain specific embodiments thereof, numerous modifications are possible and it is desired to cover all modifications falling within the spirit and scope of the invention.

What is claimed is:

1. An electrical conductor comprising a metallic conductive element having a halogen-free, flame-resistant, crosslink curable polyolefin polymer compound insulation thereabout comprising the following, in the approximate relative parts by weight of

| | |
|---|---|
| Polyolefin | 100 |
| Organopolysiloxane gum | 2–20 |
| Organic Lead compound | 1–15 |

2. The electrical conductor of claim 1, wherein the polyolefin polymer is crosslink cured.

3. The electrical conductor of claim 1, wherein the polyolefin polymer comprises at least one ethylene-containing polymer selected from the group consisting of polyethylene, copolymers of ethylene and other polymerizable materials, and blends of such polymers.

4. The electrical conductor of claim 3, wherein the polyolefin polymer has been crosslink cured with an organic peroxide curing agent.

5. An electrical conductor comprising a metallic conductor element having a halogen-free, flame-resistant, crosslink cured polyolefin polymer compound insulation thereabout comprising the following, in the approximate relative parts by weight of

| | |
|---|---|
| Polyolefin | 100 |
| Organopolysiloxane gum | 2–10 |
| Organic Lead compound | 1–5 |
| Fumed silica | 1–6 |
| Antioxidant | 1–3 |
| Filler | 0–50 |

6. The electrical conductor of claim 5, wherein the polyolefin polymer has been crosslink cured with an organic peroxide curing agent.

7. The electrical conductor of claim 5, wherein the polyolefin polymer comprises at least one ethylene-containing polymer selected from the group consisting of polyethylene, copolymers of ethylene and other polymerizable materials, and blends of such polymers.

8. The electrical conductor of claim 7, wherein the ethylene-containing polymer has been crosslink cured with an organic peroxide curing agent.

9. The electrical conductor of claim 8, wherein the antioxidant of the organopolysiloxane of the ethylene containing polymer insulation is polydimethysiloxane.

10. The electrical conductor of claim 8, wherein the antioxidant of the ethylene containing polymer compound insulation is polymerized 1,2-dihydro-2,2,4-trimethylquinoline.

11. An electrical conductor comprising a metallic conductor element having a halogen-free, flame-resistant, crosslink cured polyethylene compound insulation thereabout comprising the cured product of the following, in the approximate parts by weight of

| | |
|---|---|
| Polyethylene | 100 |
| Organopolysiloxane gum | 2–20 |
| Dibasic lead phthalate | 1–5 |
| Fumed silica | 1–6 |
| Antioxidant | 0–5 |
| Antimony oxide | 0–15 |
| Organic peroxide curing agent | 1–10 |

12. The electrical conductor of claim 11, wherein the organopolysiloxane of the polyethylene compound insulation is polydimethyl siloxane.

13. The electrical conductor of claim 11, wherein the antioxidant of the polyethylene compound insulation is polymerized 1,2-dihydro-2,2,4-trimethylquinoline.

14. An electrical conductor comprising a metallic conductor element having a halogen-free, flame-resistant, crosslink cured polyethylene compound insulation thereabout comprising the cured product of the following, in the approximate parts by weight of

| | |
|---|---|
| Polyethylene | 100 |
| Organopolysiloxane gum | 3–5 |
| Dibasic lead phthalate | 2–4 |
| Fumed silica | 2–5 |
| Antioxidant, polymerized, 1,2-dihydro-2,2,4-trimethyl-quinoline | 1–3 |
| Silicone liquid | 0–5 |

-continued

| | |
|---|---|
| Organic peroxide curing agent | 1–5 |

15. The electrical conductor of claim 14, wherein the organopolysiloxane of the polyethylene compound insulation is polydimethyl siloxane.

16. The electrical conductor of claim 1 wherein the organopolysiloxane gum has a Brookfield viscosity in excess of 100.000 centipoise at 25° C.

17. The electricial conductor of claim 1 wherein the polyolefin is 100 parts by weight of polyethylene, the organoploysiloxane gum is 4 parts by weight and the lead compound is 3 parts by weight of dibasic lead phthalate.

* * * * *